US008136921B2

(12) United States Patent
Tamada

(10) Patent No.: US 8,136,921 B2
(45) Date of Patent: Mar. 20, 2012

(54) LIQUID DROPLET EJECTION APPARATUS

(75) Inventor: Hisashi Tamada, Anjo (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 838 days.

(21) Appl. No.: 12/077,350

(22) Filed: Mar. 18, 2008

(65) Prior Publication Data

US 2008/0231668 A1 Sep. 25, 2008

(30) Foreign Application Priority Data

Mar. 20, 2007 (JP) ..... 2007-072511

(51) Int. Cl.
*B41J 2/14* (2006.01)
*B41J 2/045* (2006.01)

(52) U.S. Cl. ..... 347/47; 347/71

(58) Field of Classification Search ..... 347/47, 347/71

See application file for complete search history.

(56) References Cited

U.S. PATENT DOCUMENTS

| | | | | |
|---|---|---|---|---|
| 5,811,019 | A * | 9/1998 | Nakayama et al. | 216/27 |
| 6,083,411 | A * | 7/2000 | Nakayama et al. | 216/27 |
| 6,142,607 | A * | 11/2000 | Takata et al. | 347/47 |
| 6,431,682 | B1 * | 8/2002 | Osada et al. | 347/47 |
| 6,454,393 | B2 * | 9/2002 | Chen et al. | 347/47 |
| 6,601,937 | B2 | 8/2003 | Hotomi et al. | |
| 6,966,112 | B2 * | 11/2005 | Kawamura | 29/890.1 |
| 7,562,970 | B2 * | 7/2009 | Okuda et al. | 347/68 |
| 7,909,428 | B2 * | 3/2011 | Donaldson et al. | 347/20 |
| 2005/0062805 | A1 * | 3/2005 | Ito | 347/71 |
| 2005/0285910 | A1 | 12/2005 | Sekiguchi | |
| 2006/0001698 | A1 * | 1/2006 | Hart et al. | 347/40 |
| 2007/0085885 | A1 * | 4/2007 | Ito et al. | 347/93 |
| 2008/0030548 | A1 * | 2/2008 | Kubo | 347/50 |

FOREIGN PATENT DOCUMENTS

| | | |
|---|---|---|
| JP | 1044409 | 2/1989 |
| JP | 10166585 | 6/1998 |
| JP | 10193593 | 7/1998 |
| JP | 10-226095 | 8/1998 |
| JP | 10202919 | 8/1998 |
| JP | 11147316 | 6/1999 |
| JP | 11277743 | 10/1999 |
| JP | 2002321354 | 11/2002 |
| JP | 2005/074884 | 3/2005 |
| JP | 2007237598 | 9/2007 |
| JP | 2007237599 | 9/2007 |

* cited by examiner

*Primary Examiner* — Charlie Peng
(74) *Attorney, Agent, or Firm* — Frommer Lawrence & Haug LLP

(57) ABSTRACT

A liquid droplet ejection apparatus includes: a flow path unit including first and second pressure chambers for first and second liquids, respectively, and first and second nozzles communicating with the first and second pressure chambers, respectively, each of the first and second nozzles including a tip opening; and a pressure generating unit which generates a pressure for the liquids in the first and second pressure chambers to eject the liquids through the tip openings of the first and second nozzles. A diameter of the tip opening of the first nozzle is larger than that of the tip opening of the second nozzle and a length of the first nozzle is shorter than that of the second nozzle.

12 Claims, 8 Drawing Sheets

CL
BK
10
11
12
13
14
15
16
17
15a
16a
16b
17a
17b
33
34
35
36
37
38
39
40
41
D1
D2
t1
t2
t3

LIQUID DROPLET EJECTION APPARATUS

CROSS-REFERENCE TO RELATED APPLICATION

This application claims priority from Japanese Patent Application No. 2007-072511, filed on Mar. 20, 2007, the entire subject matter of which is incorporated herein by reference.

TECHNICAL FIELD

Aspects of the present invention relate to a liquid droplet ejection apparatus such as an ink-jet head.

BACKGROUND

A liquid droplet ejection apparatus such as an ink-jet head has been known which conveys ink supplied from an ink tank to eject ink droplets from a nozzle towards a recording sheet. The ink-jet head includes, for example, a flow path unit having nozzles for ejecting ink droplets and a piezoelectric actuator mounted on the flow path unit (see JP-A-10-226095, for example). The flow path unit includes ink flow paths formed for each ink color and nozzles communicating with the ink flow paths. The piezoelectric actuator includes piezoelectric sheets each being sandwiched by a common electrode and a plurality of individual electrodes. Herein, a required individual electrode is applied with voltage to selectively impart pressure to a corresponding ink flow path, so as to generate ink ejecting pressure.

In ink-jet printers, when forming a high-resolution image like a photography-mode image, it is required to eject color ink having a minute liquid droplet diameter. On the other hand, when forming a solid image with black ink over a wide range, it is required to eject black ink having a relatively large liquid droplet diameter so as to reduce occurrence of unevenness in density of the black color on a paper sheet. In order to satisfy these needs, the nozzle diameters may be made to differ from each other by increasing the diameter of the black ink nozzle or decreasing the diameter of the color ink nozzle. It is noted that JP-A-10-226095 describes an ink-jet printer which includes nozzles having different diameters. In the ink-jet printer, even in the case of so-called gradation printing using only the same color ink, droplets having different diameters are ejected so as to execute printing according to any desired printing mode.

In the ink-jet head described in JP-A-10-226095, nozzles have different diameters and in order to eject ink from every nozzle at a same flying speed, driving voltage of the piezoelectric actuator is adjusted for each nozzle diameter. That is to say, the active part length of the piezoelectric element and the width of the individual electrode are varied in accordance with the nozzle diameter. If the piezoelectric actuator has a nonuniform structure like the above-described structure, nonuniform deformation or variation may occur in the process of baking or the like during the manufacturing of the piezoelectric actuator, and therefore, the production cost may increase by the lowering of the yield rate.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid droplet ejection apparatus which has nozzles of different diameters and is capable of reducing the production cost.

According to an exemplary embodiment of the present invention, there is provided a liquid droplet ejection apparatus comprising a flow path unit and a pressure generating unit. The flow path unit includes: first and second pressure chambers for first and second liquids, respectively; and first and second nozzles communicating with the first and second pressure chambers, respectively, each of the first and second nozzles including a tip opening. The pressure generating unit generates a pressure for the liquids in the first and second pressure chambers to eject the liquids through the tip openings of the first and second nozzles. A diameter of the tip opening of the first nozzle is larger than that of the tip opening of the second nozzle, and a length of the first nozzle is shorter than that of the second nozzle.

According to another exemplary embodiment of the present invention, there is provided a method for manufacturing a nozzle layer for a first liquid and a second liquid. The method comprises: forming an outflow path though a semi-nozzle plate for the first liquid; laminating the semi-nozzle plate onto a nozzle plate; emitting a first laser beam to the nozzle plate through the outflow path in the semi-nozzle plate to form a nozzle for the first liquid; and emitting a second laser beam to the semi-nozzle plate and the nozzle plate to form a nozzle for the second liquid.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, exemplary embodiments of the present invention will be described with reference to the drawings. In the following description, a direction in which an ink-jet head ejects ink is referred to as "downward" and the opposite direction thereto is referred to as "upward".

First Exemplary Embodiment

Figure 1:
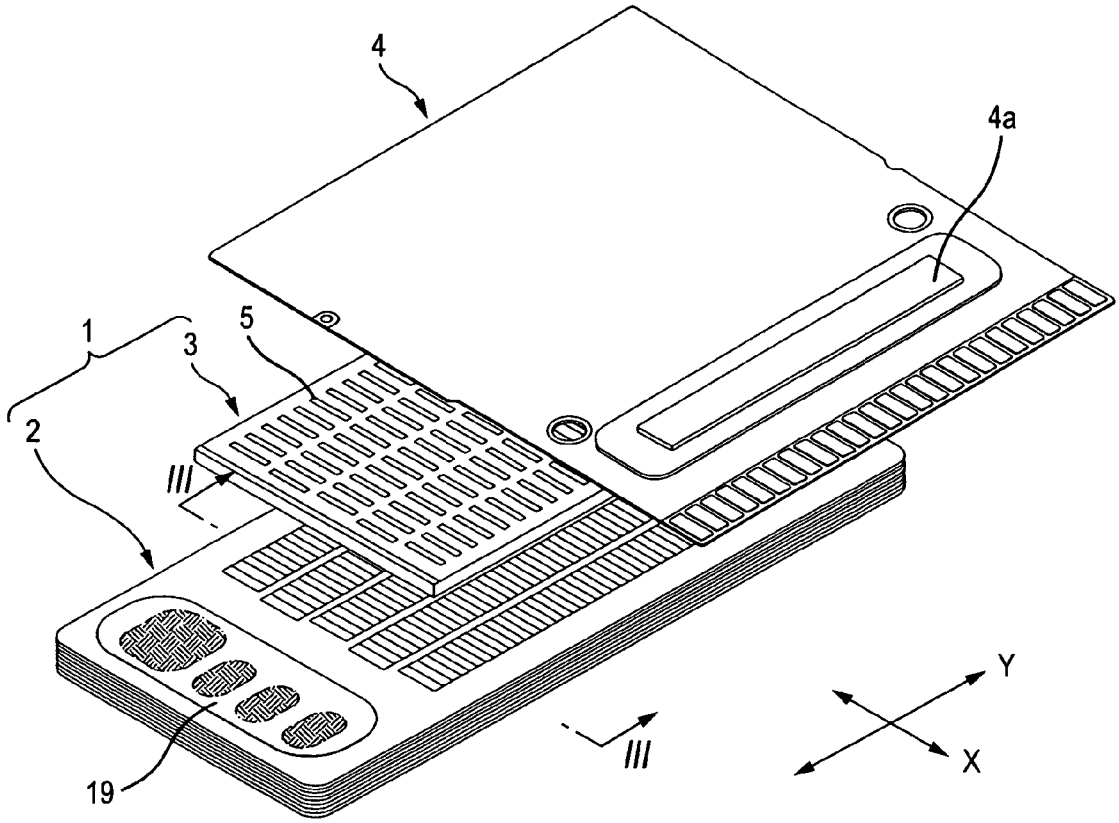
FIG. 1. is an exploded perspective view illustrating an ink-jet head according to a first exemplary embodiment of the present invention.

FIG. 1 is an exploded perspective view illustrating an ink-jet head according to a first exemplary embodiment of the present invention. As shown in FIG. 1, an ink-jet head 1 includes a flow path unit 2 formed by laminating a plurality of plates, and a piezoelectric actuator 3 mounted on and adhered to the flow path unit 2. The flow path unit 2 includes nozzles 38, 39 open through a lower surface and ink is ejected downward from the nozzles 38, 39 (see FIG. 3). Surface electrodes 5 are formed on an upper face of the piezoelectric actuator 3 such that the piezoelectric actuator is applied with driving voltage for ejecting ink, and are overlapped thereon with a flexible flat cable 4 for achieving electrical connection with external devices. This flexible flat cable 4 is mounted with a drive IC circuit 4*a* which outputs a signal for selectively drive the piezoelectric actuator 3 based on printing data, and terminals (not shown) exposed downward from a lower face of the IC circuit 4*a* are electrically connected to the surface electrodes 5 of the piezoelectric actuator 3. The ink-jet head 1 is loaded on a head holder (not shown), and the head holder is fixed to a guide shaft (not shown). The ink-jet head 1 ejects ink downward from the nozzles 38, 39 while performing scanning in a reciprocating manner in a main-scanning direction (X direction) so as to perform printing on a recording medium fed by a sheet feeder in a sub-scanning direction (Y direction) orthogonal to the main-scanning direction.

Figure 2:
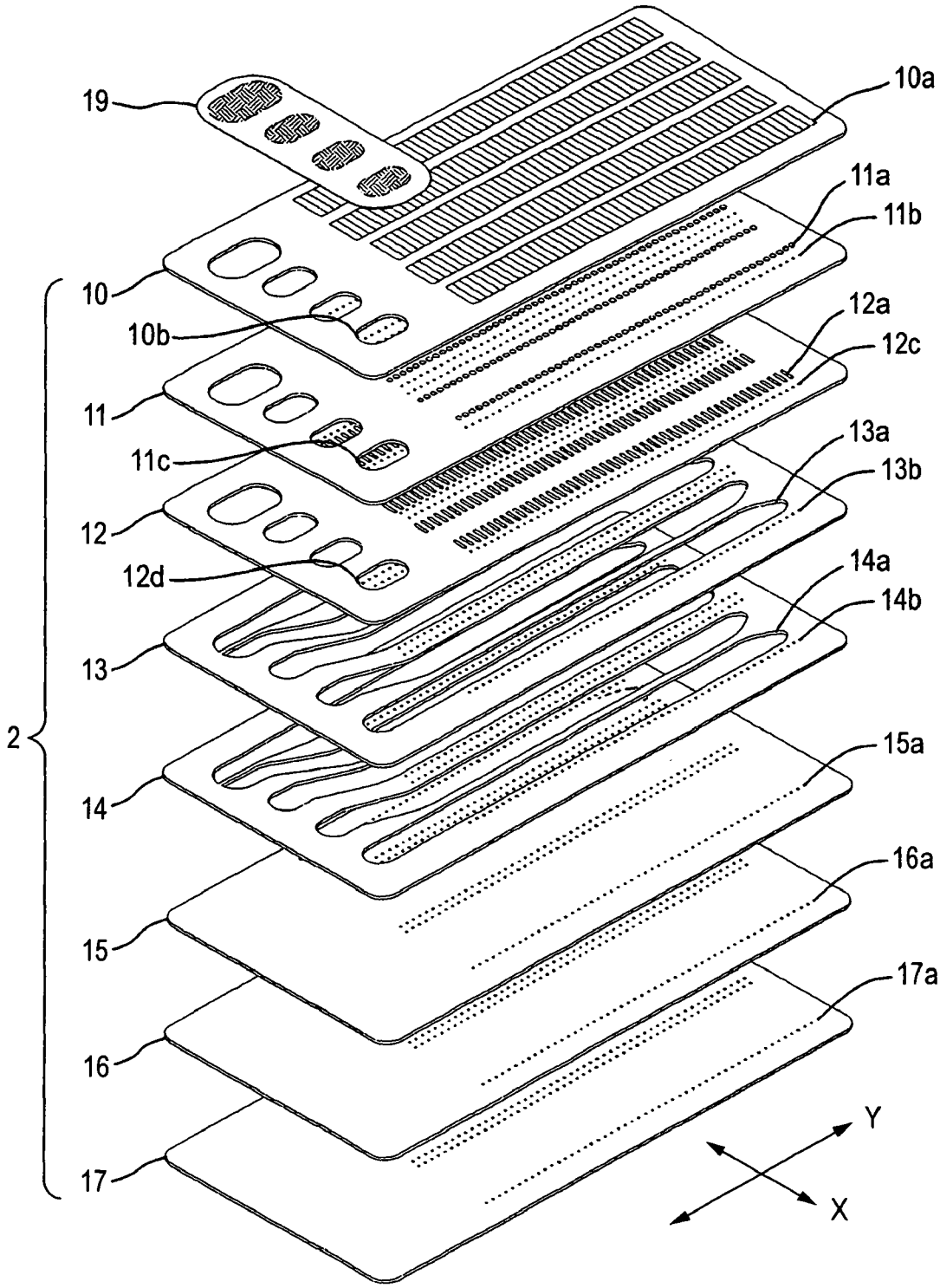
FIG. 2 is an exploded perspective view of a flow path unit of the ink-jet head illustrated in FIG. 1.
Figure 3:
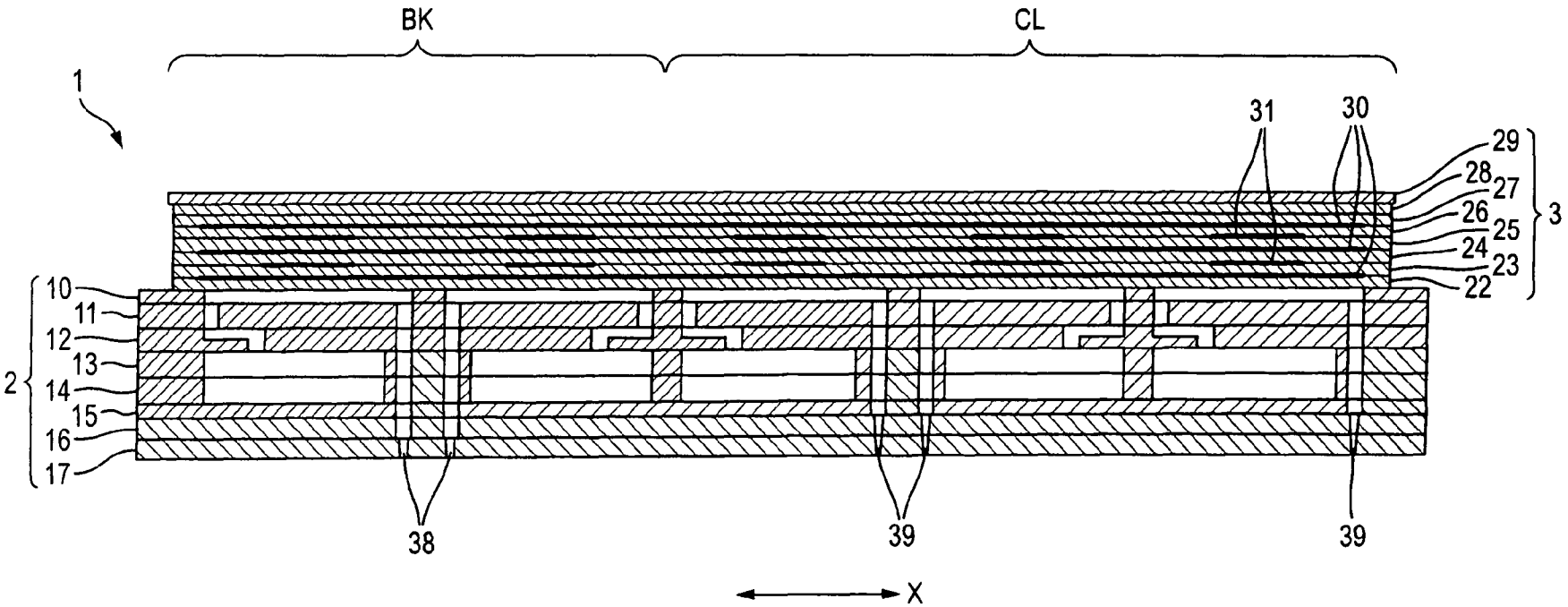
FIG. 3 is an enlarged view of a part of a cross section taken along the line III-III of FIG. 1.

FIG. 2 is an exploded perspective view of the flow path unit 2 of the ink-jet head 1 illustrated in FIG. 1. FIG. 3 is a cross section taken along the line III-III of FIG. 1. As shown in FIG. 2 and FIG. 3, the flow path unit 2 is configured so that ink supplied from an ink tank (not shown) to ink supply ports 10*b*, 11*c*, 12*d* is ejected from the nozzles 38, 39 (FIG. 3) exposed downward on the lower face side via a plurality of ink flow paths, which are described later. The ink supply ports 10*b*, 11*c*, 12*d* are arranged in four rows in the X direction for each color. The nozzles are arranged in five rows in the X direction, wherein the three rows at the right side of the figure are color ink rows (hereinafter, referred to as "color ink row CL") for ejecting color ink of any of cyan, magenta and yellow, and the two rows at the left side are black ink rows (hereinafter, referred to as "black ink row BK") for ejecting black ink. Since black ink is used frequently, black ink is supplied from an ink supply port (at the left side of the figure) dedicated to the black ink row BK to the nozzles of the two rows of the black ink row BK via a plurality of ink flow paths.

Figure 4:
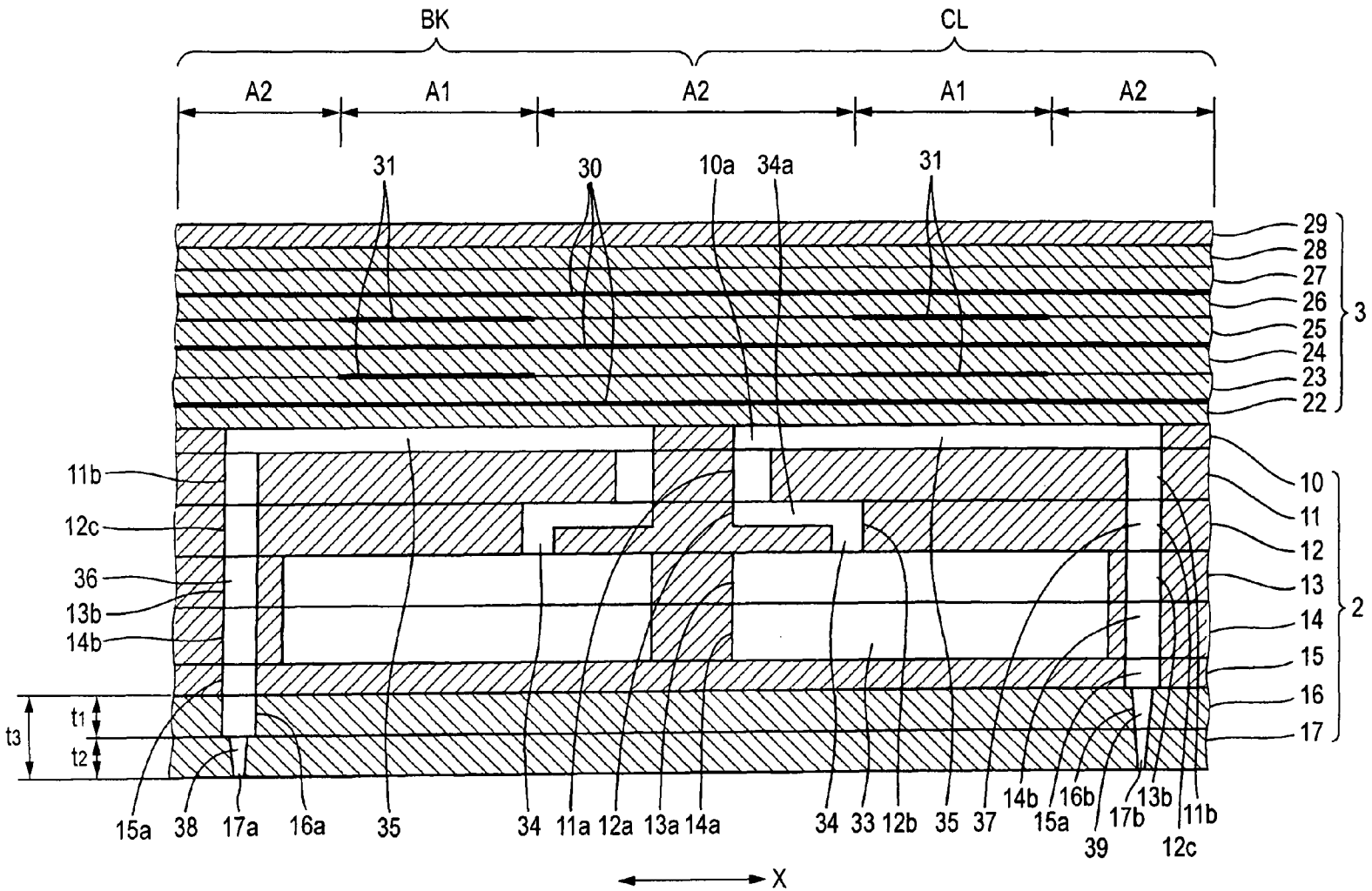
FIG. 4 is an enlarged view of a part of FIG. 3.

FIG. 4 is an enlarged view of a part of FIG. 3, illustrating the black ink row BK and the color ink row CL corresponding to the second row and the third row from the left side of FIG. 3 in an enlarged manner. As shown in FIG. 2 and FIG. 4, the flow path unit 2 includes a pressure chamber plate 10, a first connecting flow path plate 11, a second connecting flow path plate 12, a first manifold plate 13, a second manifold plate 14, a cover plate 15, a semi-nozzle plate 16 and a nozzle plate 17, which are laminated and adhered to each other downward in this order. The semi-nozzle plate 16 and the nozzle plate 17 are resin sheets made of polyimide or the like. The nozzle plate 17 has a thickness t2 (for example, 45 to 55 μm) that is substantially same as a thickness t1 of the semi-nozzle plate 16. The other plates 10 to 15 are metal plates such as 42% nickel alloy steel plates (42 alloy), respectively having a plate thickness in a range from 40 to 150 μm. Each of the plates 10 to 17 has openings or recesses formed by electrolytic etching, laser machining or plasma-jet processing to form flow paths.

As shown in FIG. 2, the pressure chamber plate 10 includes a plurality of pressure chamber holes 10*a* formed therethrough and have an elongate shape as seen in a plan view thereof (elongate in the X direction) and aligned along the long side (the Y direction) of the pressure chamber plate 10, and the ink supply ports 10*b*. Thus formed pressure chamber plate 10 constitutes a pressure chamber layer. The pressure chamber holes 10*a* are aligned in five rows for each ink color (two rows for black ink) in the X direction, and the ink supply ports 10*b* are aligned in four rows for each ink color in the X direction. The ink supply ports 10*b* are covered with a filter 19 for removing dusts mixed in the ink supplied from an ink tank (not shown).

As shown in FIG. 2 and FIG. 4, the first connecting flow path plate 11 includes communication holes 11*a* formed therethrough, respectively communicating with one ends of the pressure chamber holes 10*a*, outflow through holes 11*b* communicating with the other ends of the pressure chamber holes 10*a*, and ink supply ports 11*c* having the same shape as the ink supply ports 10*b* and communicating with the ink supply ports 10*b*.

The second connecting flow path plate 12 includes recesses 12*a* formed along the long-axial direction of the pressure chamber holes 10*a* (X direction) and communicating at one end thereof with the communication holes 11*a*, communication holes 12*b* formed therethrough at the other end of the recesses 12*a*, outflow through holes 12*c* communicating with the outflow through holes 11*b*, and ink supply ports 12*d* having the same shape as the ink supply ports 11*c* and communicating with the ink supply ports 11*c*. And, a connection flow path layer is constituted by the first connecting flow path plate 11 and second connecting flow path 12.

The first manifold plate 13 includes first manifold holes 13*a* formed therethrough and extending below the pressure chamber holes 10*a* along the rows thereof (Y direction) so as to communicate with the pressure chamber holes 10*a* through the communication holes 12*b*, and outflow through holes 13*b* formed therethrough and respectively communicating with the outflow through holes 12*c*.

The second manifold plate 14 includes second manifold holes 14*a* formed therethrough and respectively communicating with the first manifold holes 13*a* at overlapping positions therewith, and outflow through holes 14*b* formed therethrough and respectively communicating with the outflow through holes 13*b*. And, a common liquid chamber layer is constituted by the first manifold plate 13 and the second manifold plate 14.

The cover plate 15 includes outflow through holes 15*a* formed therethrough and respectively communicating with the outflow through holes 14*b*, and closes the second manifold holes 14*a* from below.

The semi-nozzle plate 16 includes outflow through holes 16*a* formed therethrough and communicating with the outflow through holes 15*a* of the black ink row BK, and nozzle holes 16*b* formed therethrough, communicating with the outflow through holes 15*a* of the color ink row CL and tapering downward.

The nozzle plate 17 includes nozzle holes 17*a* formed therethrough, communicating with the outflow through holes 16*a* of the black ink row BK and tapering downward, and nozzle holes 17*b* formed therethrough, communicating with the nozzle holes 16*b* of the color ink row CL and tapering downward. Herein, the cover plate 15 may be formed with recessed damper chambers at overlapping positions with the manifold holes 14*a*. And the damper chambers are shaped substantially same as the manifold holes 14*a* and have openings on the side of the semi-nozzle plate 16. As a matter of course, a separate damper plate may be provided on the lower side of the second manifold plate 14. The separate damper plate is formed with damper chambers.

Next, the ink flow paths within the flow path unit 2 will be explained with reference to FIG. 4. Upper and lower openings of the manifold holes 13*a* and 14*a* formed through the first and second manifold plates 14, 14 are closed by the second connecting flow path plate 12 and the cover plate 15, whereby common liquid chambers 33 are formed.

Each of the common liquid chambers 33 communicates, at one end thereof, with the ink supply ports 10*b*, 11*c* and 12*d* for each ink color (see FIG. 2), and extends in the Y direction so as to overlap a pressure chambers 35 arranged in the Y direction as seen in a plan view. The common liquid chambers 33 in two rows are supplied with ink from the ink supply port for black ink.

Each of the common liquid chambers 33 communicates with one end of the pressure chamber 35 located above, via a crank-shaped connecting flow path 34. The connecting flow path 34 is constituted by the communication hole 11*a* of the first connecting flow path plate 11, and the recess 12*a* and communication hole 12*b* of the second connecting flow path plate 12. The connecting flow path 34 has a narrowed portion 34*a* where the flow path sectional area is the smallest and the flow path resistance is the largest in the entire flow path from the common liquid chamber 33 to the pressure chamber 35.

The pressure chambers 35 are formed by closing the upper and lower openings of the pressure chamber holes 10*a* with the piezoelectric actuator 3 and the first connecting flow path plate 11. The respective common liquid chambers 33, connecting flow paths 34 and pressure chambers 35 of the black ink row BK have substantially same shape and size as those of the color ink row CL.

Outflow paths 36, 37 connecting to the nozzles 38, 39 communicate with the other ends of the pressure chambers 35, respectively. The outflow path 36 for the black ink row BK is formed by the outflow through holes 11*b*, 12*c*, 13*b*, 14*b*, 15*a*, 16*a*, and the outflow path 37 for the color ink row CL is formed by the outflow through holes 11*b*, 12*c*, 13*b*, 14*b*, 15*a*. Each of the outflow paths 36, 37 is vertically formed in the laminating direction (a direction orthogonal to surfaces of the plates), and has a flow path section (for example, diameter of 150 to 180 μm) which is substantially uniform in the axial direction of the flow path (ink flowing direction). It is noted that a length of the outflow path 36 of the black ink row BK is slightly longer than a length of the outflow path 37 of the color ink row CL, but these outflow paths 36, 37 are substantially same with each other in flow path diameter.

The outflow paths 36, 37 are communicated with taper-shaped nozzles 38, 39 gradually tapering (decreasing in diameter) toward the lower tip openings. The nozzle 38 of the black ink row BK is formed only by the nozzle hole 17*a* of the nozzle plate 17, whereas the nozzle 39 of the color ink row CL is formed by the nozzle hole 16*b* of the semi-nozzle plate 16 and the nozzle hole 17*b* of the nozzle plate 17. Accordingly, the length t2 of the nozzle 38 of the black ink row BK is smaller than a length t3 (=t1+t2) of the nozzle 39 of the color ink row CL. Also, the nozzle 38 has a tip opening diameter D1 (for example, diameter of 25 to 35 μm) of the nozzle 38 of the black ink row BK. And, the nozzle 39 has a tip opening diameter D2 (for example, diameter of 15 to 25 μm) of the nozzle 39 of the color ink row CL. That is, the tip opening diameter D1 is larger than the tip opening diameter D2.

Further, the nozzle 38 of the black ink row BK and the nozzle 39 of the color ink row CL have a substantially same tapering angle. Herein, a nozzle in this specification of the present invention means parts of the flow paths located downstream from portions at which flow path sectional area is reduced to 80% or less as compared with the sectional area of the outflow paths 36, 37. It is noted that the nozzle in this specification of the present invention may denote a part having a surface (including a taper surface) continuously extending from the tip opening to the outflow path without any step.

As illustrated in FIG. 4, the piezoelectric actuator 3 includes a plurality of piezoelectric sheets 22 to 28 and a top sheet 29 laminated with one another. Each of the piezoelectric sheets 22 to 28 are made of ceramic material of piezoelectric zirconate titanate (PZT) and has a thickness of substantially 30 μm. The top sheet 29 has electric insulation properties. On the upper faces of the odd-numbered piezoelectric sheets 22, 24, 26 as counted upward starting from the piezoelectric sheet 22 which is the lowermost layer of the piezoelectric sheets 22 to 26, common electrodes 30 continuously arranged in a range corresponding to the pressure chambers 35 are formed by printing. On the upper faces of the even-numbered piezoelectric sheets 23, 25 as counted upward starting from the piezoelectric sheet 22 which is the lowermost layer of the piezoelectric sheets 22 to 26, a plurality of individual electrodes 31 arranged at positions corresponding to respective pressure chambers 35 are formed by printing in five rows.

The piezoelectric actuator 3 includes active parts A1 which are sandwiched between the individual electrodes 31 and the common electrodes 30 and which are deformable when applied with voltage, and inactive parts A2 which are the remaining parts and which are not applied with voltage. The individual electrodes 31 of the black ink row BK and the color ink row CL have substantially same shape and size in correspondence with the pressure chambers 35.

The common electrodes 30 and the individual electrodes 31 are electrically conducted to the surface electrodes 5 (see FIG. 1) on the upper face of the top sheet 29, via relay conductors (not shown) provided at the side end faces of the piezoelectric sheets 22 to 28 and the top sheet 29, or at through holes (not shown).

Figure 5:
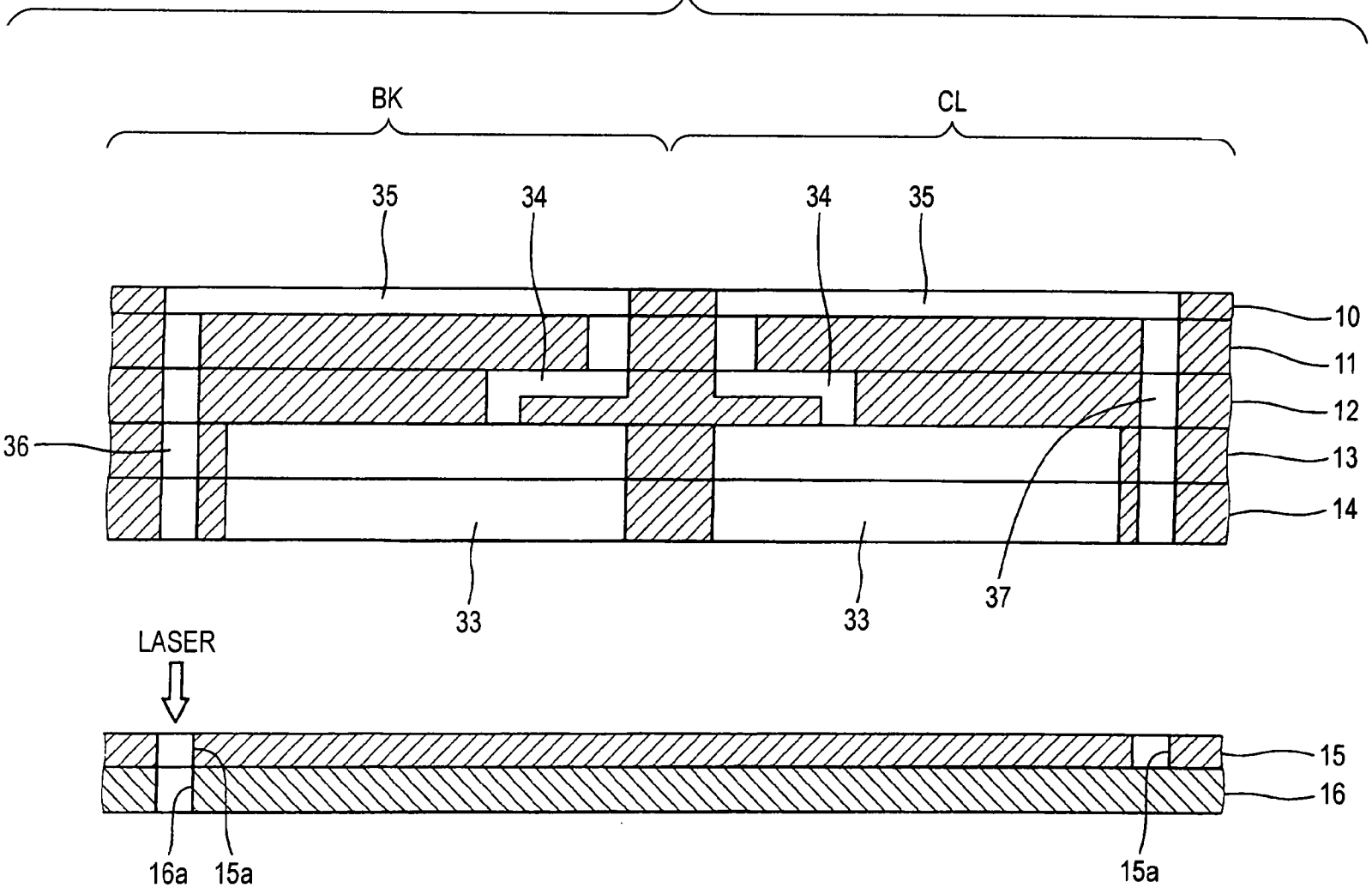
FIG. 5 is a cross-sectional view illustrating a first manufacturing process of the flow path unit shown in FIG. 4.
Figure 6:
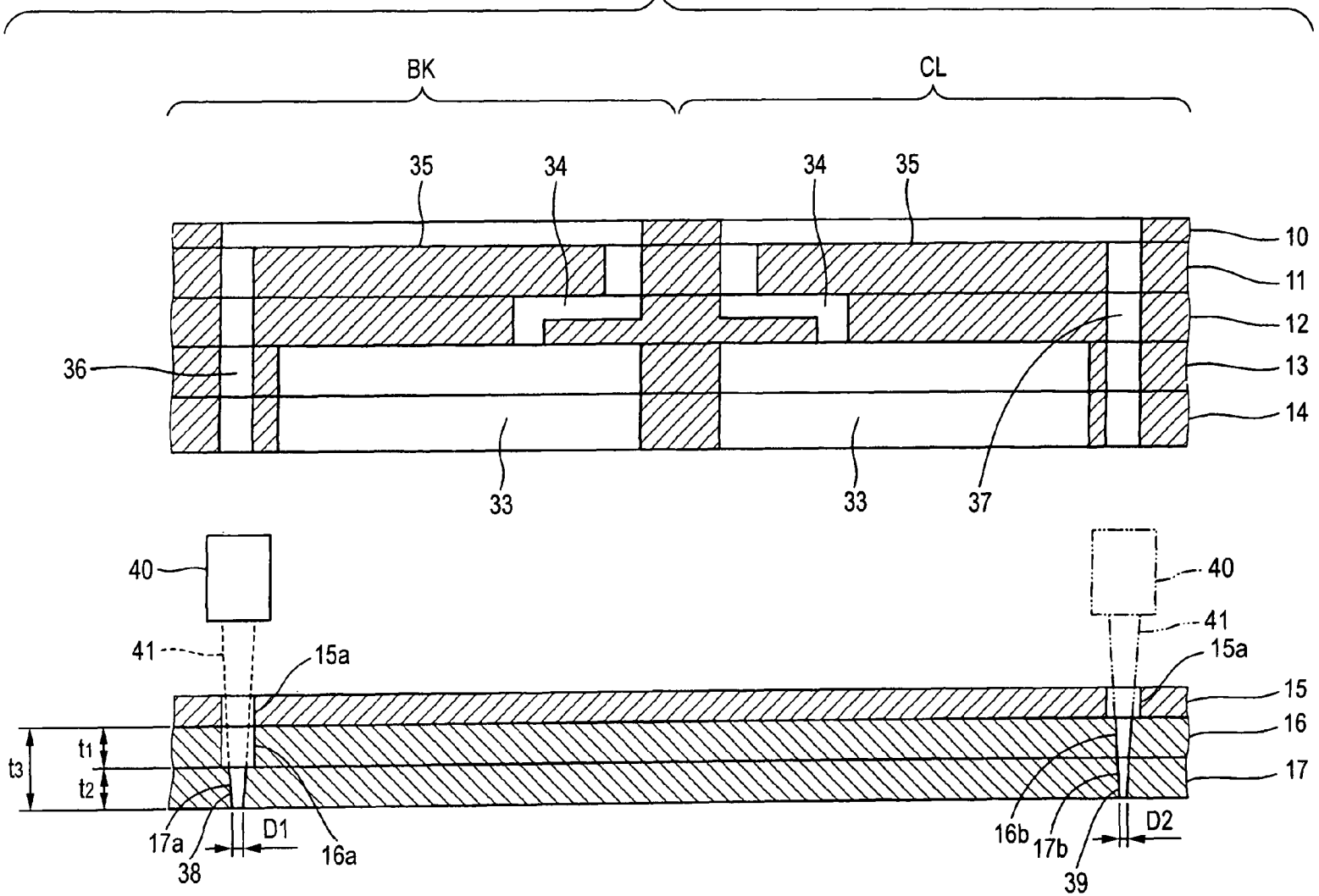
FIG. 6 is a cross-sectional view illustrating a second manufacturing process of the flow path unit shown in FIG. 4.

Next, the manufacturing method of the flow path unit 2 will be explained. FIG. 5 is a cross-sectional view illustrating a first manufacturing process of the flow path unit 2 shown in FIG. 4. FIG. 6 is a cross-sectional view illustrating a second manufacturing process of the flow path unit shown in FIG. 4. As shown in FIG. 5, at first, as the first manufacturing process, a plurality of ink flow paths are formed by adhesively laminating the plates 10 to 14 made of metal plates such as 42% nickel alloy steel plates (42 alloy) which are formed with a plurality of holes by electrolytic etching, laser machining, plasma-jet processing, press work, or the like. Separately, an unprocessed resin sheet made of polyimide or the like and forming the semi-nozzle plate 16 is adhered from below to the cover plate 15 including the outflow through holes 15*a* formed therethrough by any one of the above-described methods. Next, only for the black ink row BK, the outflow through holes 16*a*, each forming the outflow path 36 in the semi-nozzle plate 16, are processed by laser machining from the side of the cover plate 15 through the outflow through holes 15*a*. The outflow through holes 16*a* has a diameter same as a diameter of the outflow through holes 15*a*. The outflow through holes 16*a* may be formed by adhesively laminating the semi-nozzle plate 16 previously formed by etching or pressing onto the plates 10 to 15 from below.

Next, as the second manufacturing process, as shown in FIG. 6, an unprocessed resin sheet made of polyimide or the like to form the semi-nozzle plate 17 is adhesively attached from below to the semi-nozzle plate 16. Subsequently, for the black ink row BK, a laser irradiation device 40 downwardly emits a laser beam 41 with a converging angle, from the side of the cover plate 15, toward the nozzle plate 17 through the outflow through holes 15*a*, 16*a* by a short time so as to form the tapered nozzle hole 17*a*.

For the color ink row CL, the laser irradiation device 40 downwardly emits a laser beam 41 with a converging angle, from the side of the cover plate 15, toward the semi-nozzle plate 16 and the nozzle plate 17 through the outflow through hole 15*a* by a short time so as to form the tapered nozzle holes 16*b*, 17*b* at one time.

Energy output from the laser irradiation device 40 is adjusted in correspondence to the diameters of the respective nozzle holes 17*a*, 17*b*. Lastly, the adhesively laminated plates 10 to 14 and the plates 15 to 17 are adhesively joined.

According to the above-described procedure, the flow path unit 2 is configured such that the length t2 of the nozzle 38 of the black ink row BK in the flow path axial direction is made to be smaller than the length t3 of the nozzle 39 of the color ink row CL in the flow path axial direction. Additionally, the tip opening diameter D1 of the nozzle 38 of the black ink row BK is made to be larger than the tip opening diameter D2 of the nozzle 39 of the color ink row CL. Accordingly, even if the flow path unit 2 has various nozzle opening diameter and various nozzle length like the above configuration, the flow path unit 2 can be manufactured with high accuracy.

According to the above-described configuration, the tip opening diameter D1 of the nozzle 38 of the black ink row BK is larger than the tip opening diameter D2 of the nozzle 39 of the color ink row CL. Additionally, the length t2 of the nozzle 38 of the black ink row BK is smaller than the length t3 of the nozzle 39 of the color ink row CL. Therefore, the flying speeds of ink droplets ejected from the respective nozzles 38, 39 can be made substantially equal to each other. That is to say, if the tip opening diameter D1 is larger like the nozzle 38 of the black ink row BK, the flying speed of ejected ink droplets tends to be slow. On the other hand, if the nozzle length is larger like the nozzle 39 of the color ink row, the interval of loss becomes longer and the flying speed of ejected ink droplets tends to be slow. Accordingly, it is possible to make the nozzles 38, 39 respectively having different tip opening diameters D1, D2 eject liquid droplets at a substantially equal flying speed. Although the outflow paths 36, 37 respectively of the black ink row BK and color ink row CL are different from each other in flow path axial directional length (for example, 550 to 650 μm), such length is much larger in scale than the lengths of the nozzles 38, 39 so that the influence affected thereby on the flying speed of ink droplets is negligible.

As a result, even if the active parts A1 of the piezoelectric actuator 3 are formed to have substantially same shape and size between the black ink row BK and the color ink row CL, it is possible to make the flying speeds of ink droplets coincide with each other between the black ink row and the color ink row CL. In other words, by forming the piezoelectric sheets 22 to 28 and the individual electrodes 31 to have substantially same structure between the black ink row BK and the color ink row CL, the structural characteristics of the piezoelectric actuator 3 can be uniformed. Accordingly, it becomes possible to lower the possibility of occurrence of uneven deformation and variation in form in the process of baking or the like during manufacture of the piezoelectric actuator 3, thereby improving the yield rate and reducing the production cost.

Second Exemplary Embodiment

Figure 7:
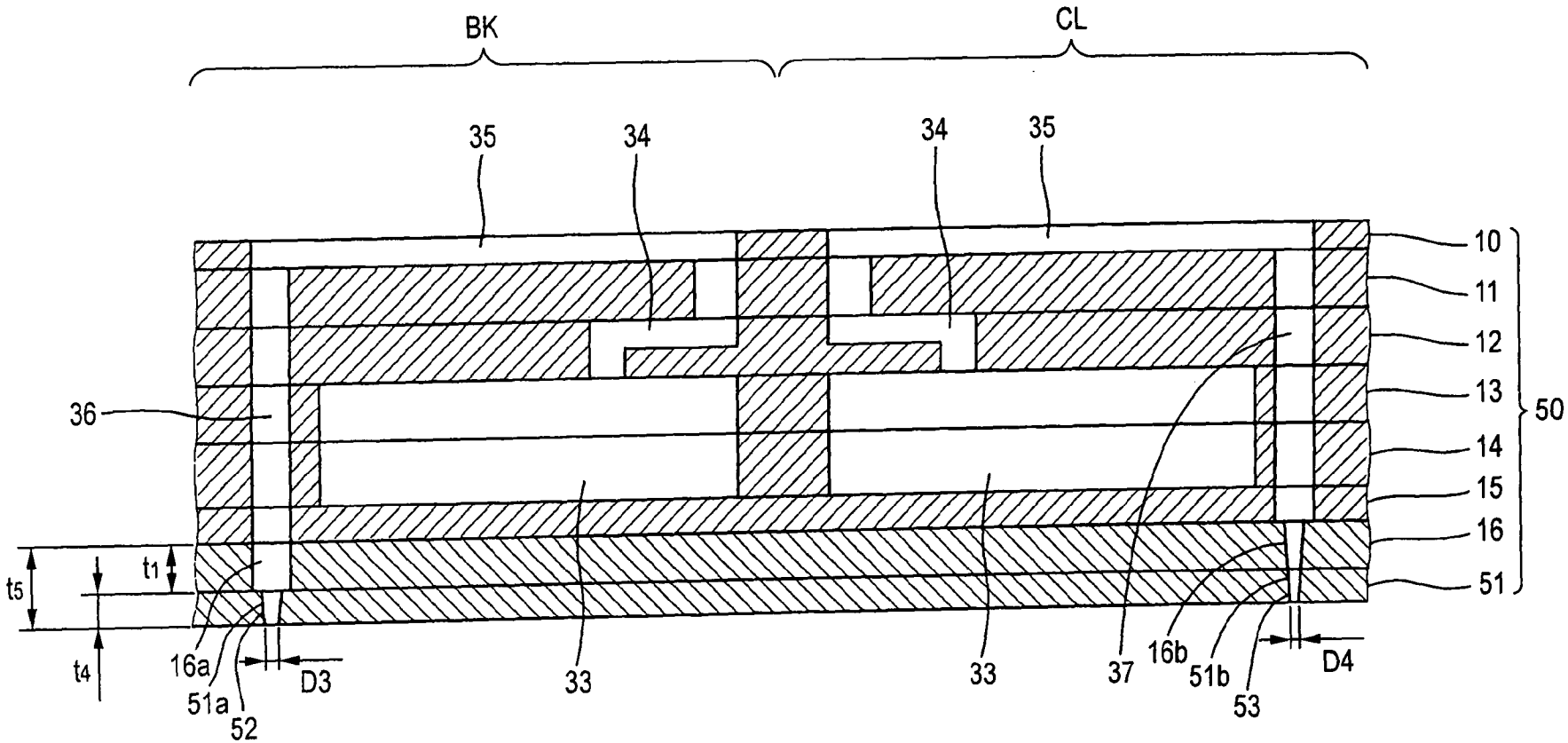
FIG. 7 is a cross-sectional view of a part of a flow path unit of an ink-jet head according to a second exemplary embodiment of the present invention.

FIG. 7 is a cross-sectional view of a part of a flow path unit 50 of an ink-jet head according to a second exemplary embodiment of the present invention. The difference from the first exemplary embodiment is in that the thickness of a semi-nozzle plate 16 and the thickness of a nozzle plate 51 are different from each other. Accordingly, components which are the same as those in the first exemplary embodiment are denoted by same reference numerals, and descriptions thereof will be omitted. As shown in FIG. 7, in the flow path unit 50 of the second exemplary embodiment, the thickness t4 of the nozzle plate 51 is smaller than the thickness t1 of the semi-nozzle plate 16.

In the black ink row BK, a nozzle 52 is formed only by a nozzle hole 51*a* of the nozzle plate 51, whereas in the color ink row CL, a nozzle 53 is formed by the nozzle hole 16*b* of the semi-nozzle plate 16 and a nozzle hole 51*b* of the nozzle plate 51. A tip opening diameter D3 of the nozzle 52 of the black ink row BK is larger than a tip opening diameter D4 of the nozzle 53 of the color ink row CL. Further, a length t4 of the nozzle 52 of the black ink row BK is smaller than a length t5 (=t1+t4) of the nozzle 53 of the color ink row CL. And, the value of t4/t5 becomes less than 0.5. Accordingly, it is possible to easily change the ratio of the nozzle length t4 of the nozzle 52 of the black ink row BK to the nozzle length t5 of the nozzle 53 of the color ink row CL, by merely thinning the nozzle plate 51 as compared with the nozzle plate 16.

Third Exemplary Embodiment

Figure 8:
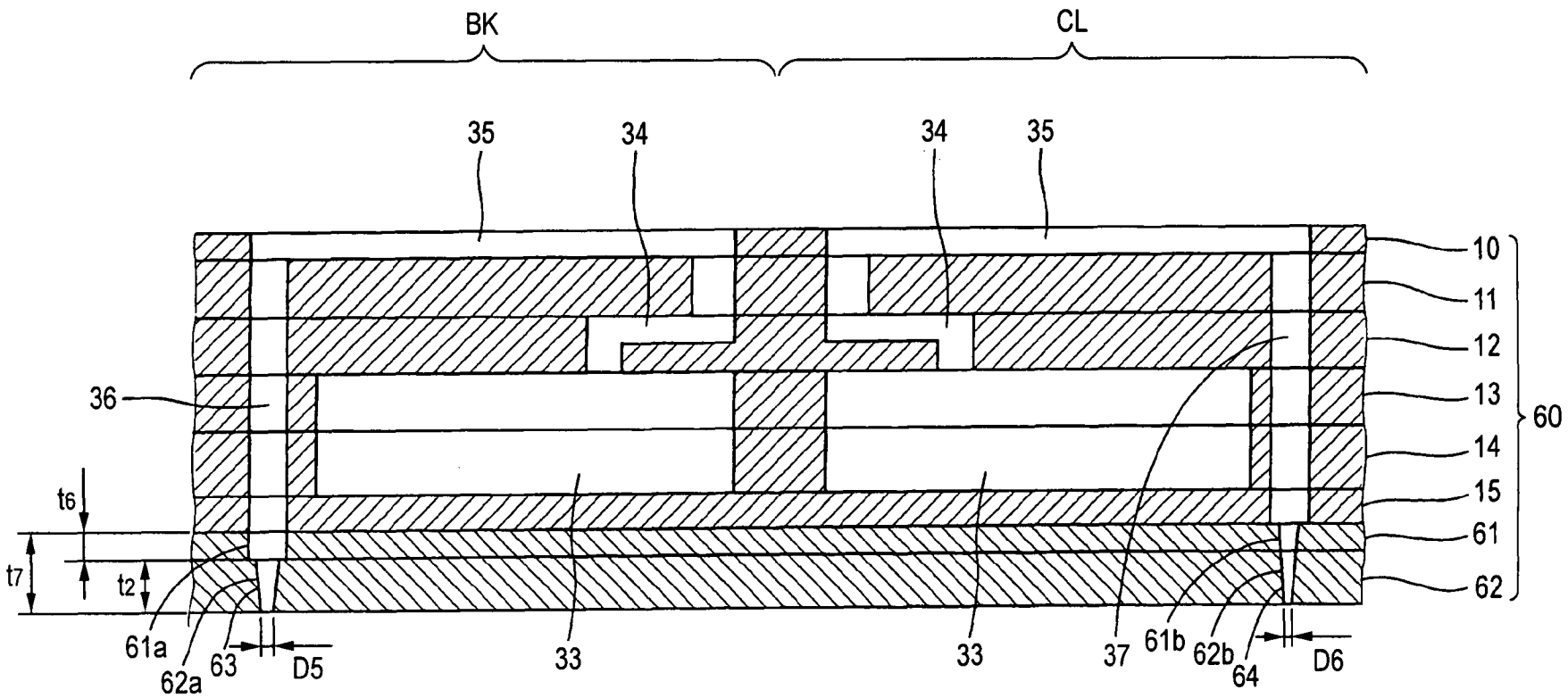
FIG. 8 is a cross-sectional view of a part of a flow path unit of an ink-jet head according to a third exemplary embodiment of the present invention.

FIG. 8 is a cross-sectional view of a part of a flow path unit 60 of an ink-jet head according to a third exemplary embodiment of the present invention. The difference from the first exemplary embodiment is in that the thickness of a semi-nozzle plate 61 and the thickness of a nozzle plate 62 are different from each other. Accordingly, components which are the same as those in the first exemplary embodiment are denoted by same reference numerals, and descriptions thereof will be omitted. As shown in FIG. 8, in the flow path unit 60 of the third exemplary embodiment, the thickness t2 of the nozzle plate 62 is larger than the thickness t6 of the semi-nozzle plate 61.

In the black ink row BK, a nozzle 63 is formed only by a nozzle hole 62*a* of the nozzle plate 62, whereas in the color ink row CL, a nozzle 64 is formed by a nozzle hole 61*b* of the semi-nozzle plate 61 and a nozzle hole 62*b* of the nozzle plate 62. A tip opening diameter D5 of the nozzle 63 of the black ink row BK is larger than a tip opening diameter D6 of the nozzle 64 of the color ink row CL. Further, a length t2 of the nozzle 63 of the black ink row BK is smaller than the length t7 (=t2+t6) of the nozzle 64 of the color ink row CL, the value of t2/t7 being larger than 0.5. Accordingly, it is possible to easily change the ratio of the nozzle length t7 of the nozzle 64 of the color ink row CL to the nozzle length t2 of the nozzle 63 of the black ink row BK, by merely increasing the thickness of the nozzle plate 62 as compared with that of the semi-nozzle plate 61.

In each of the above-described exemplary embodiments, two plates are used to form a nozzle, but one or three or more plates may be used instead.

Further, in each of the above-described exemplary embodiments, the tip opening diameter of the nozzles in the black ink row is larger than that of the nozzles in the color ink row, and the length of the nozzles in the black ink row is smaller than that of the nozzles in the color ink row CL. However, it may not necessarily be limited to black ink and color ink. For example, in the case of an ink-jet head where there are two rows of ink nozzles for each of the four colors including black, yellow, magenta and cyan (total eight rows), out of the nozzles in two rows for ejecting the same color ink, the nozzle in one row may have a larger diameter and a smaller length while the nozzle in the other row may have a smaller diameter and a larger length. In this way, by designing the nozzles for a same single color to have different nozzle tip opening diameters and nozzle lengths, it becomes possible to execute liquid droplet gradation printing. Accordingly, this design may be preferable for any ink-jet printers in which printing is executed in accordance with each intended mode such as high-resolution photographic mode printing and solid printing or text printing.

Further, although the above-described exemplary embodiments explain an ink-jet head to which an inventive concept of the present invention is applied, the inventive concept may also be applied to an apparatus for manufacturing color filters of liquid crystal displays by ejecting a liquid other than ink, such as a colored liquid, as well as a liquid droplet ejecting apparatus for use in, for instance, an apparatus for forming electric wiring by ejecting an electrically conductive liquid. Furthermore, in each of the above-described exemplary embodiments, a piezoelectric actuator is used as the pressure generating unit, but another actuator may be used instead such as an actuator which is deformable by static electricity.

According to exemplary embodiments of the present invention, the tip opening diameter D1 of the nozzle 38 of the black ink row BK is larger than the tip opening diameter D2 of the nozzle 39 of the color ink row CL. Additionally, the length t2 of the nozzle 38 of the black ink row BK is smaller than the length t3 of the nozzle 39 of the color ink row CL. Therefore, the flying speeds of ink droplets ejected from the respective nozzles 38, 39 can be made substantially equal to each other. That is to say, if the tip opening diameter D1 is larger like the nozzle 38 of the black ink row BK, the flying speed of ejected ink droplets tends to be slow. On the other hand, if the nozzle length is larger like the nozzle 39 of the color ink row, the interval of loss becomes longer and the flying speed of ejected ink droplets tends to be slow. As a result, it becomes unnecessary to change, for each nozzle diameter, active parts A1 of the piezoelectric actuator 3 that imparts ejection pressure to the liquid within the pressure chambers 35 of the flow path unit 2, thus making it possible to reduce the production cost.

According to exemplary embodiments of the present invention, the active parts A1 have substantially same shape and size and do not vary according to each nozzle diameter, thus structural uniformity of the piezoelectric actuator 3 can be achieved. Accordingly, it becomes possible to lower the possibility of occurrence of nonuniform deformation and variation in form in the process of baking or the like during the manufacture of the piezoelectric actuator 3, improving the yield rate as well as reducing the production cost.

According to exemplary embodiments of the present invention, nozzles having different tip opening diameters are substantially same in tapering angle, so that it becomes easier to form nozzles having different tip opening diameters in a single process by employing laser machining, for example, thus improving productivity.

According to exemplary embodiments of the present invention, the tip opening diameter of the nozzles for black ink is larger so that when printing a solid image with black ink over a wide range, black ink having a large liquid droplet diameter can be ejected on a paper sheet without causing unevenness in density of the black color. Further, the tip opening diameter of the nozzles for color ink is smaller, so that it is possible to eject color ink having a small liquid droplet diameter when forming a high-resolution image like a photography-mode image.

According to exemplary embodiments of the present invention, for the same ink color, there may be provided with nozzles having a larger tip opening diameter and nozzles having a smaller tip opening diameter, so that it is possible to eject both larger and smaller droplets of the same color ink, allowing it to favorably execute liquid droplet gradation printing in accordance with an intended mode ranging from photography mode like high-resolution image printing to solid printing or text printing.

According to exemplary embodiments of the present invention, with a simple configuration, the nozzle having a larger tip opening diameter and the nozzle having a smaller tip opening diameter can be made to differ from each other in nozzle length.

According to exemplary embodiment of the present invention, with a simple configuration, the length of the nozzle having a larger tip opening diameter can be made substantially half of the length of the nozzle having a smaller tip opening diameter.

According to exemplary embodiment of the present invention, it is possible to easily change the proportion of the nozzle length of the nozzle having a larger tip opening diameter to the nozzle length of the nozzle having a smaller tip opening diameter by simply changing the thickness of the plates used.

As described above, the liquid droplet ejection apparatus according to exemplary embodiments of the present invention has an excellent effect of reducing the production cost and is advantageously applicable to an ink-jet head or the like.

What is claimed is:

1. A liquid droplet ejection apparatus comprising:

a flow path unit including:

first and second pressure chambers for first and second liquids, respectively; and first and second nozzles communicating with the first and second pressure chambers, respectively, each of the first and second nozzles including a tip opening; and a pressure generating unit which generates a pressure for the liquids in the first and second pressure chambers to eject the liquids through the tip openings of the first and second nozzles;

wherein a diameter of the tip opening of the first nozzle is larger than that of the tip opening of the second nozzle;

wherein both the first and second nozzles extend in a first direction;

wherein a length of the first nozzle is shorter than that of the second nozzle in the first direction; and wherein each of the first and second nozzles are taper-shaped flow paths which decrease in diameter toward the tip opening thereof.

2. The liquid droplet ejection apparatus according to claim 1;

wherein the pressure generating unit includes a piezoelectric actuator having first and second active parts which are deformable and mounted on one side of the flow path unit and which are arranged to be opposed to the first and second pressure chambers, respectively;

wherein the first and second pressure chambers have a substantially same shape and size; and wherein the first and second active parts have a substantially same shape and size.

3. The liquid droplet ejection apparatus according to claim 1;

wherein a tapering angle of the first nozzle is substantially same as that of the second nozzle.

4. The liquid droplet ejection apparatus according to claim 1;

wherein the first liquid includes a black ink and the second liquid includes a color ink

5. The liquid droplet ejection apparatus according to claim 1;

wherein the first liquid and the second liquid include a same color ink.

6. The liquid droplet ejection apparatus according to claim 1;

wherein the flow path unit is formed by laminating a plurality of plates having holes for forming a plurality of flow paths; and wherein the number of plates forming the first nozzle is smaller than the number of plates forming the second nozzle so that the length of the first nozzle is shorter than that of the second nozzle.

7. The liquid droplet ejection apparatus according to claim 6;

wherein the plurality of plates include:

a nozzle plate, through which the first and second nozzles are formed; and a semi-nozzle plate, through which the second nozzle is formed but the first nozzle is not formed.

8. The liquid droplet ejection apparatus according to claim 7;

wherein a thickness of the nozzle plate is substantially same as that of the semi-nozzle plate.

9. The liquid droplet ejection apparatus according to claim 7;

wherein a thickness of the nozzle plate is different from that of the semi-nozzle plate.

10. The liquid droplet ejection apparatus according to claim 7;

wherein the nozzle plate and the semi-nozzle plate are made of different material from other plates included in the plurality of plates.

11. The liquid droplet ejection apparatus according to claim 10;

wherein the nozzle plate and the semi-nozzle plate are made of resin.

12. The liquid droplet ejection apparatus according to claim 1;

wherein the flow path unit further includes first and second outflow paths which connect first and second pressure chambers with the first and second nozzles, respectively;

wherein a cross section of the first outflow path is substantially uniform therethrough; and wherein a cross section of the second outflow path is substantially uniform therethrough.

* * * * *